US005161319A

United States Patent [19]

Boyd

[11] Patent Number: 5,161,319

[45] Date of Patent: Nov. 10, 1992

[54] PORTABLE IRONING BOARD AND CASE COVER

[76] Inventor: Mary Boyd, 7718 S. Phillips, Chicago, Ill. 60649

[21] Appl. No.: 597,837

[22] Filed: Dec. 20, 1990

[51] Int. Cl.[5] ..... D06F 81/02; D06F 83/00; A47B 85/00; A45C 9/00

[52] U.S. Cl. ..... 38/139; 38/140; 38/103; 38/104; 38/112; 190/130; 190/13 E; D32/66; 150/107

[58] Field of Search ..... 38/103, 104, 112, 135, 38/137, 138, 139, 140, DIG. 1, 1 A, 2, 66; 190/11, 130; 108/11, 34, 115; D32/66; 150/107

[56] References Cited

U.S. PATENT DOCUMENTS

| | | | |
|---|---|---|---|
| 1,445,566 | 2/1923 | Stoll | 38/112 X |
| 2,432,932 | 12/1947 | Peters | 38/103 |
| 2,783,562 | 3/1957 | Smith | 38/139 X |
| 3,441,112 | 4/1969 | Maben | 190/11 |
| 3,483,954 | 12/1969 | Michalski | 38/104 X |
| 3,512,620 | 5/1970 | Bell et al. | 38/112 X |
| 3,516,523 | 6/1970 | Pemberton | 38/104 X |
| 3,614,794 | 10/1971 | Rodgers | 108/34 X |
| 4,621,003 | 11/1986 | Okane | 38/140 X |
| 4,890,704 | 1/1990 | Harris | 38/112 X |
| 4,986,395 | 1/1991 | Lewis | 38/112 X |

FOREIGN PATENT DOCUMENTS

| | | | |
|---|---|---|---|
| 0126333 | 1/1932 | Austria | 38/103 |

*Primary Examiner*—Werner H. Schroeder
*Assistant Examiner*—Ismael Izaguirre

[57] ABSTRACT

A portable, collapsible ironing board and case cover designed for travel, convenience and compactness. The ironing board and core cover consists of the following parts: The case/cover, three board sections, two hinges, five legs, six draw catch fastners, four wood supports, screws and hook and loop fasteners. The three board sections are connectedd by two continuous hinges on the top side of the board sections and are supported underneath by the wood supports which provides a brace for the board when fully extended. The six draw catch fastners are provided to secure the ironing board when in operation. There are a total of five legs to provide standing ability and added support for the ironing board. The hook and loop fasteners are used as a closure for the case and as a fastener when used for the ironing board cover. The shoulder strapped case converts to an ironing board cover for the light. Weight plywood ironing board. The case/cover provides for a unique method of transporting a portable collapsible ironing board.

6 Claims, 6 Drawing Sheets

FIG. 1
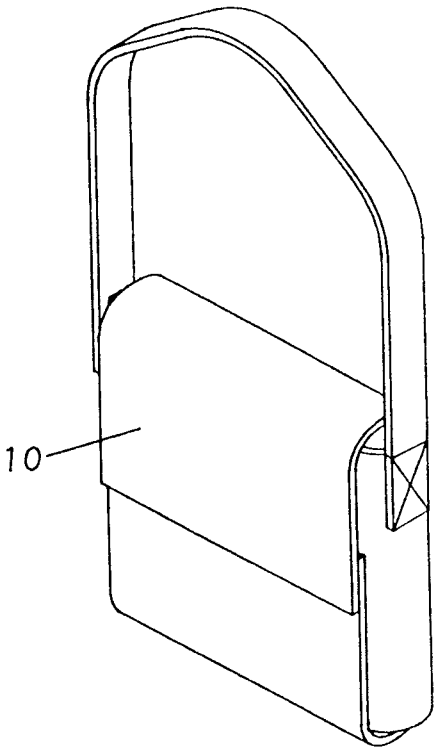
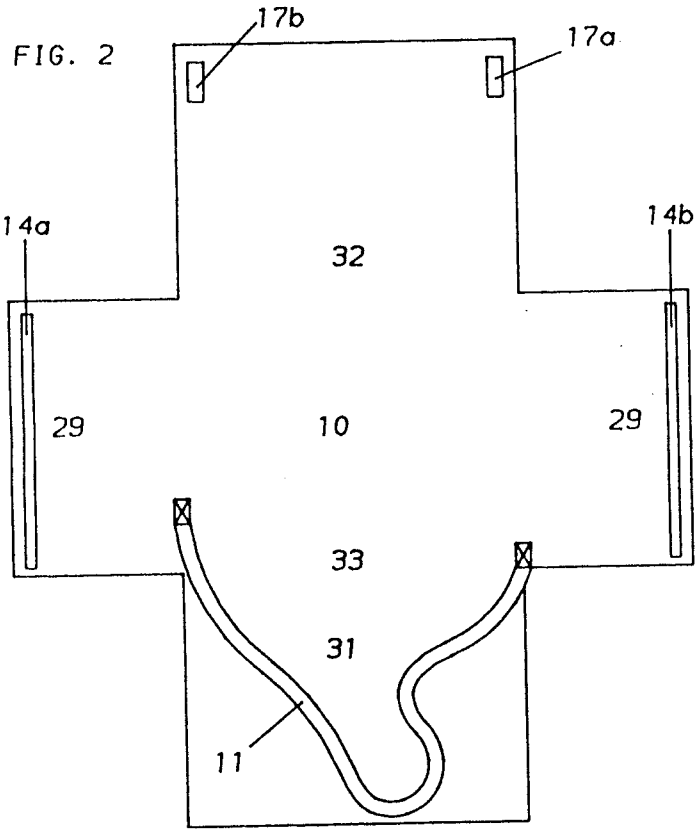
FIG. 2

PORTABLE IRONING BOARD AND CASE COVER

BACKGROUND OF THE INVENTION

1. Field of the Invention

The present invention relates to portable ironing boards encased in luggage form with hand grip handles or shoulder straps.

2. Description of the Related Art

Some of the ironing boards of the prior art are heavy, cumbersome to transport, difficult to operate, and expensive to manufacture.

The present invention is made of a light weight material with the convenience of hand free carrying via a fabric shoulder strapped case.

The case also converts to a padded ironing board cover for added convenience.

SUMMARY OF THE INVENTION

The invention relates to portable ironing boards. The object of this invention is to provide an improved method over the prior art, in consideration of weight, more compact convenience and greater manageability. It is an object of this invention to provide an ironing board that folds neatly along two continuous hinges. When extended, the ironing board is secured with draw catches and is supported by legs. Also provided is hand free carrying of the folded board via a fabric shoulder strapped case that converts to an ironing board cover. Yet another object of this invention is to provide simplicity of design and operation, efficiency, sturdiness of construction and an invention that is inexpensive to manufacture.

BRIEF DESCRIPTIONS OF THE DRAWINGS

Other characteristics and advantages of the present invention will become clear from reading the descriptions hereinbelow with reference to the attached drawings, wherein:

FIG. 1 is a perspective view of a shoulder case with a portable ironing board inside the carrying case/cover produced in accordance with the invention.

FIG. 2 is a view of the case/cover when opened flat on the travel case side.

DESCRIPTION OF THE PREFERRED EMBODIMENTS

The invention relates to a portable ironing board adapted to be collapsed into a square shape foldable and insertable into a shoulder strapped case that converts into an ironing board cover.

Figure 3:
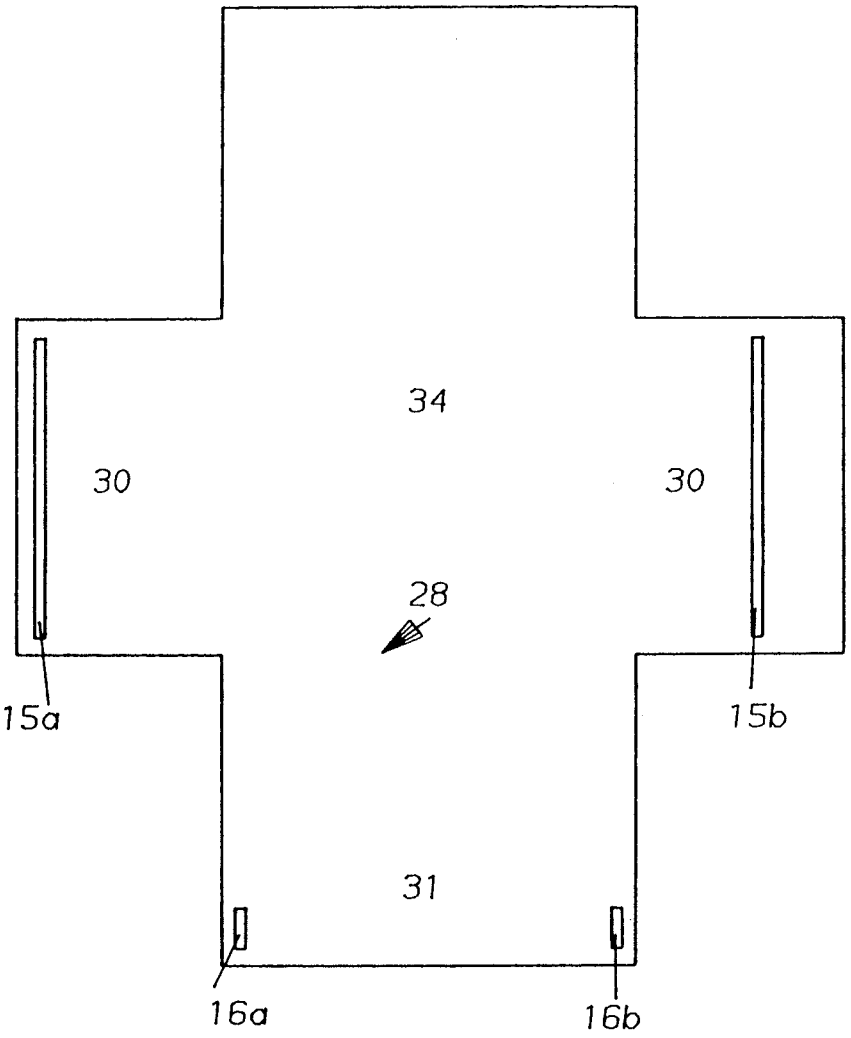
FIG. 3 is a view of the case/cover when opened flat on the reverse side to either receive the ironing board for storage or to be used as a padded cover for the ironing board.

In reference to the drawings, the general numeral 27 is designated for the portable ironing board in accordance with the invention. In FIG. 1, reference numeral 10 denotes a perspective view of a carrying case. This carrying case is constructed of a durable fabric suitable for carrying the ironing board which includes padding 28 (generally designated in FIG. 3) for ironing convenience. The case/cover has a shoulder strap 11 as shown in FIG. 2 and "VELCRO" fasteners, that is, hook and loop fasteners. The hook and loop fasteners 14*a* and 14*b* are on side flaps 29 as shown in FIG. 2, and hook and loop fasteners 15*a* and 15*b* are on flaps 30 as shown in FIG. 3. These side flaps fold one over the other, and fasten by either connecting 14*a* to 15*a*, or 14*b* to 15*b* in the center.

The case/cover further has front flap 31 with hook and loop fasteners 16*a* and 16*b* (shown in FIG. 3) and back flap 32 with hook and loop fasteners 17*a* and 17*b*. These flaps fold one over the other and fasten by connecting 16*a* to 17*a* and 16*b* to 17*b*. Thusly, flaps 29, 30, 31, and 32 fold over to hold the ironing board in place during storage or transport. Also shown in FIG. 2, the case/cover 10 is opened flat on the travel side 33 revealing the overall design of the case/cover comprising the shoulder strap 11 and FIG. 3 shows the ironing board cover with ironing surface 34. When the case/cover is used for ironing purposes, the ironing surface 34 can be secured underneath the ironing board shown in FIG. 4 in its extended position by the hook and loop fasteners on the flaps described above.

Figure 4:
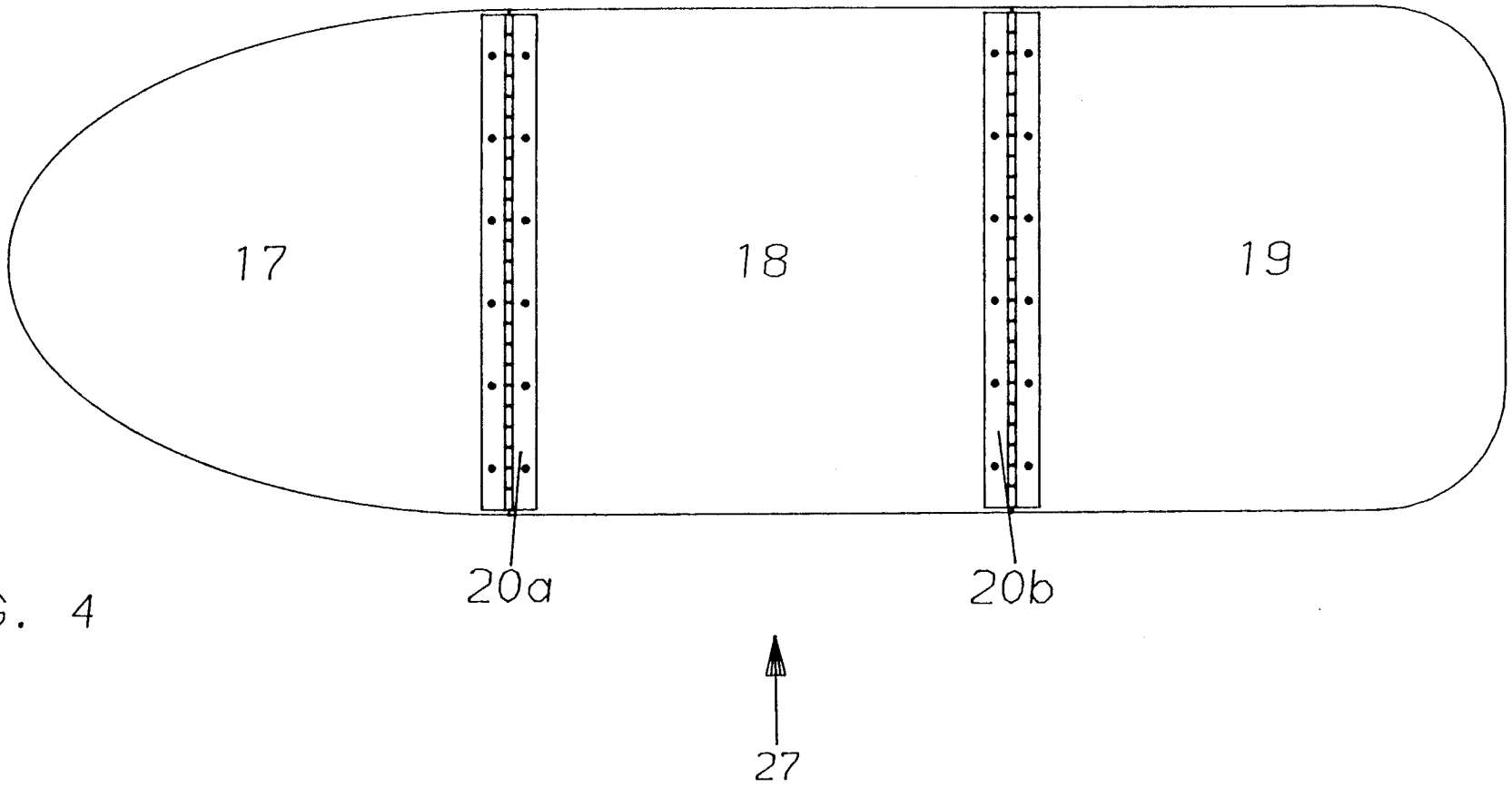
FIG. 4 is a top view with three board sections extended for operation.
Figure 5:
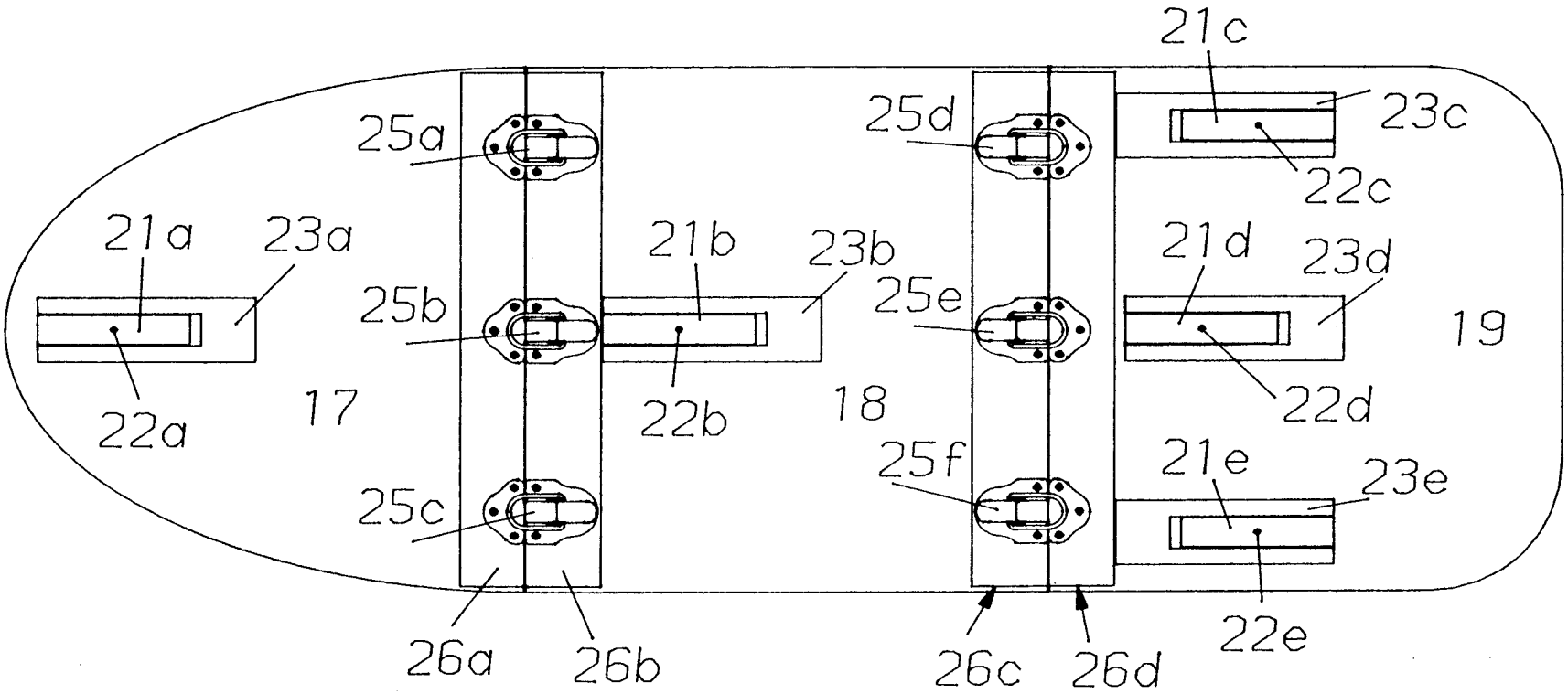
FIG. 5 is a bottom view, displaying five legs in a folded position over connected leg rests and six draw catch fasteners attached to four wood supports, securing the sections when in an extended position.

FIG. 4 shows the ironing board sections 17, 18, and 19 having continuous hinges 20*a* and 20*b*, that allow the sections to fold for storage of the ironing board in a retracted position. FIG. 5 shows a full view of the underside of the ironing board. There are six draw catch fasteners 25*a*, 25*b*, 25*c*, 25*d*, 25*e*, and 25*f* which are attached to the wood supports 26*a*, 26*b*, 26*c*, and 26*d* and are clearly showing how the board sections are secured when fully extended for operation. There is a leg configuration in the center of each board section 17, 18, and 19, all of which are shown in FIGS. 5 through 9 positioned longitudinally in the same direction with respect to a longitudinal length of the ironing board.

Figure 6:
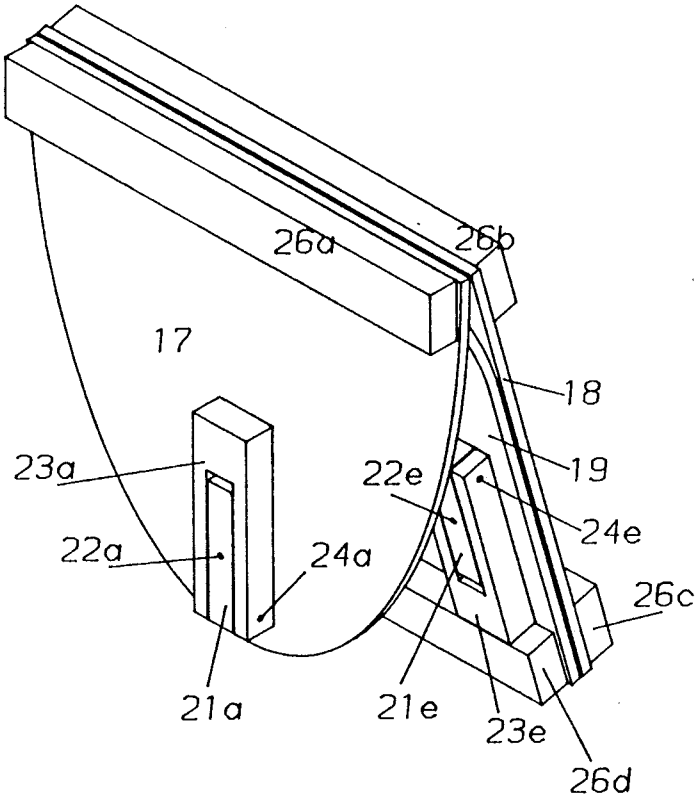
FIG. 6 is a view of how the front oval section folds over the rear section.

The front leg 23*a* as shown in FIG. 6 is in a storage position folded over a leg rest 21*a*. The leg rest is secured by a single screw in the center 22*a*. The leg has a hollowed portion and is pivotally attached to the leg rest by a screw 24*a* (shown in FIG. 6) allowing the leg to be raised and lowered at will by acting as a hinge. The front leg gives standing ability to the front oval shaped board section 17. There is also only one leg configuration 23*b* on the middle board section 18. The leg 23*b* folds over leg rest 21*b*. The leg rest is attached to the board section by 22*b*, and the leg has a hollow portion that swingably attaches to the leg rest by screw 24*b* (shown in FIG. 8) which acts as a hinge. The middle leg 23*b* leans against wood support 26*b* when raised to a standing position.

There are three leg configurations on the end board section 19 (shown in FIGS. 5, 6, and 9); two side leg configurations and one middle leg configuration 23*d*. The end section center leg 23*d* has a hollow portion that folds over leg support 21*d*, and this leg support is attached to the board by screw 22*d*. Leg 23*d* is pivotally attached to the leg support 21*d* by screw 24*d*, which acts as a hinge. The leg leans against wood support 26*d* and contributes to the front leg 23*a* and middle leg 23*b* for standing ability of the ironing board when in operation.

The side leg configurations 23*c* and 23*e* have the same structure between the two, and therefore the description of only one will suffice here. In leg configuration 23*e* of end section 19, the leg 23*e* has a hollowed portion which rests on leg rest 21*e*. Leg rest 21*e* is attached to the end section by screw 22*e*, and the leg is rotatably attached to the leg rest by screw 24*e*. The screw 24*e* (shown in FIGS. 6 and 9) acts as a hinge to raise and lower the leg at will. These side leg configurations provide balanced standing and stability to the other legs 23*a*, 23*b*, and 23*d* and the board when in operation.

Figure 7:
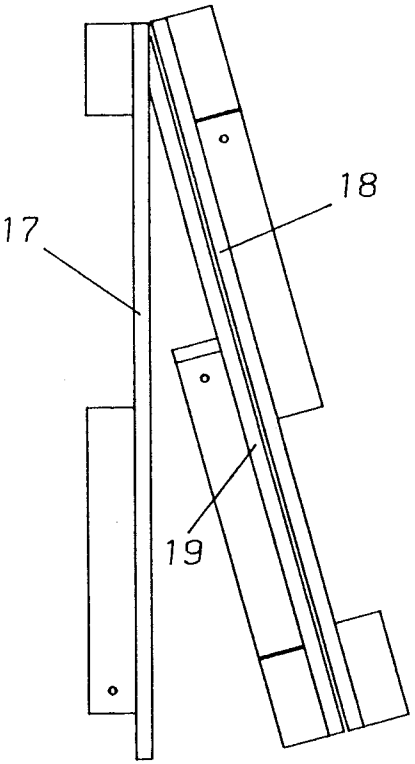
FIG. 7 is an overall side view of said collapsible portable ironing board.

As shown in FIG. 6, the ironing board is partially folded revealing the underside of the front oval shaped section 17 whereon is leg configuration 23*a*. Further reference to FIG. 6 shows the four wood supports 26*a*, 26*b*, 26*c*, and 26*d*, they are attached to each board section to give the necessary support to the extended ironing board. FIG. 6 shows the side positions of the leg and leg rest configurations of the end sections 17 and 19. In FIG. 7, a side view showing the method of folding the ironing board is provided. Section 19 is folded over section 18 and then section 17 is folded over section 19.

Figure 8:
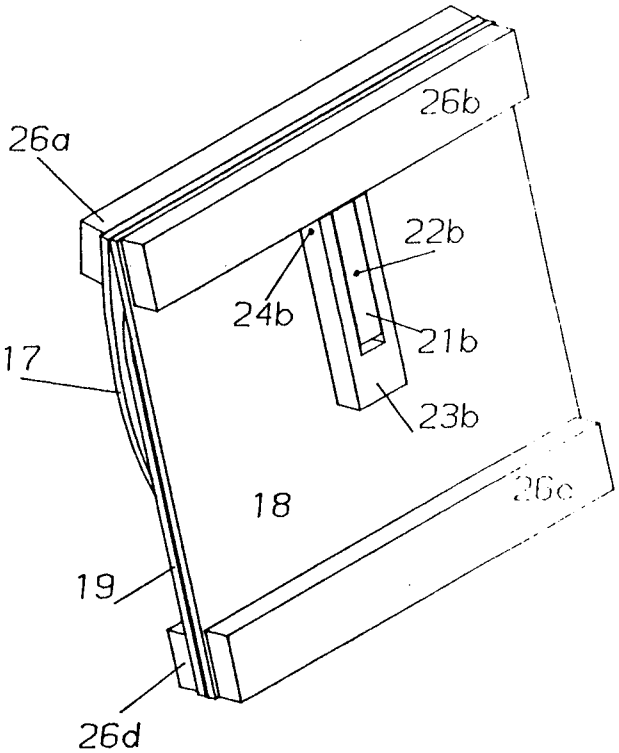
FIG. 8 is a display of the complete fold that forms a square shape to fit into the shoulder case as shown in FIG. 1.
Figure 9:
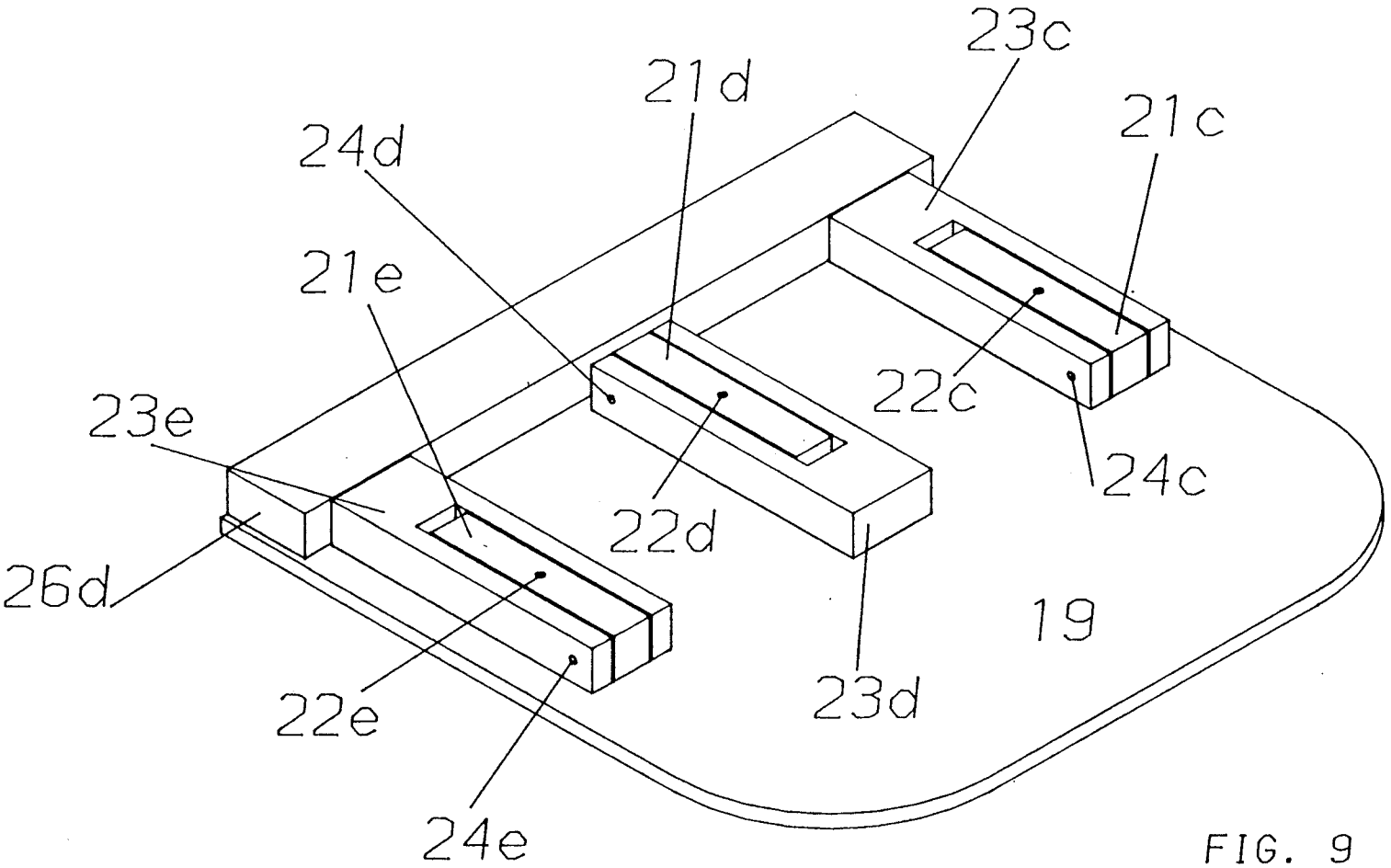
FIG. 9 is the end section with three legs and a wood support

FIG. 8 shows a perspective view of the folded ironing board in a folded position for storage in its overall compact square shaped design without the shoulder strapped case/cover. FIG. 9 shows a perspective view of the underside of the end section 19 of the portable ironing board in accordance with the invention with the wood support 26*d* and the three leg configurations 23*c*, 23*d*, and 23*e*, the operation and structure of which have been described above.

In the drawings and the specification, there has been set forth a preferred embodiment of the invention, and although specific terms were employed, they are used in a generic and descriptive sense only, and not for purposes of limitation. It will be apparent to those skilled in the art that various changes and modifications may be made without departing from the spirit of the invention in its broader aspects. The scope of the invention being set forth in the appended claims.

I claim:

1. A collapsible portable ironing board and case/cover comprising:

a sectional ironing board having an extended position and a retracted position, said board having three board sections hingably attached, said sections being foldable to form said retracted position;

an ironing board cover for covering an upper surface of the ironing board in said extended position, said cover forming an ironing surface, and wherein said ironing board cover is removable and foldable for forming a carrying case with a shoulder strap and flaps, said case enclosing the retracted ironing board; and wherein said flaps have hook and loop fasteners.

2. The collapsible portable ironing board and case/cover according to claim 1 wherein;

said cover converts to a padded portable ironing board case/cover and is fastened to the extended ironing board with said hook and loop fasteners to secure said cover in place while ironing.

3. The collapsible portable ironing board and case/cover according to claim 1 wherein;

the three board sections are connected together by hinges, portions of said hinges are joined to a middle board section and to end board sections to form a complete portable hinged ironing board, said board being foldable so as to fit within said carrying case.

4. The collapsible portable ironing board case/cover according to claim 3 comprising;

supports positioned underneath the ironing board sections to stablize said sections and give additional support to said hinges.

5. A collapsible portable ironing board and case/cover according to claim 4 comprising;

means for locking said board sections in place in said extended position.

6. The collapsible portable ironing board and case/cover according to claim 5 comprising;

leg configurations, wherein each configuration has means for raising and lowering said legs.

* * * * *